US006521386B1

(12) United States Patent
Sakon et al.

(10) Patent No.: US 6,521,386 B1
(45) Date of Patent: Feb. 18, 2003

(54) ELECTROPHOTOGRAPHIC PHOTORECEPTOR AND ELECTROPHOTOGRAPHIC IMAGE FORMING METHOD AND APPARATUS USING THE PHOTORECEPTOR

(75) Inventors: Yohta Sakon, Shizuoka-ken (JP); Narihito Kojima, Shizuoka-ken (JP); Minoru Umeda, Shizuoka-ken (JP); Masao Yoshikawa, Kanagawa-ken (JP); Hiroshi Nagame, Shizuoka-ken (JP); Ryuta Takeichi, Kanagawa-ken (JP); Akiyo Namiki, Kanagawa-ken (JP)

(73) Assignee: Ricoh Company Ltd., Tokyo (JP)

( * ) Notice: Subject to any disclaimer, the term of this patent is extended or adjusted under 35 U.S.C. 154(b) by 0 days.

(21) Appl. No.: 09/504,799

(22) Filed: Feb. 15, 2000

(30) Foreign Application Priority Data

Feb. 16, 1999 (JP) ..... 11-037691

(51) Int. Cl.[7] ..... G03G 5/047

(52) U.S. Cl. ..... 430/58.15; 430/58.25; 430/58.55; 430/58.35; 430/58.7; 430/58.75; 430/58.85; 430/120; 430/125; 399/111; 399/116; 399/123; 399/346

(58) Field of Search ..... 430/58.05, 66, 430/67, 56, 120, 125, 58.15, 58.4, 58.5, 58.55, 58.35, 58.75, 58.85, 58.25, 58.45, 58.65, 58.7; 399/116, 159, 111, 123, 346

(56) References Cited

U.S. PATENT DOCUMENTS

| | | | | |
|---|---|---|---|---|
| 4,435,074 A | * | 3/1984 | Midorikawa | 399/346 |
| 5,206,103 A | * | 4/1993 | Stolka et al. | 430/63 |
| 5,350,653 A | | 9/1994 | Shoshi et al. | 430/83 |
| 5,409,792 A | * | 4/1995 | Yanus et al. | 430/58.6 |
| 5,486,438 A | | 1/1996 | Shoshi et al. | 430/83 |
| 5,492,784 A | | 2/1996 | Yoshikawa et al. | 430/56 |
| 5,504,559 A | * | 4/1996 | Ojima et al. | 430/126 |
| 5,874,876 A | | 2/1999 | Ikuno et al. | 430/96 |
| 5,908,725 A | * | 6/1999 | Ueda | 430/69 |
| 5,942,360 A | * | 8/1999 | Janezic et al. | 430/66 |
| 6,030,733 A | * | 2/2000 | Kami et al. | 430/56 |
| 6,030,734 A | * | 2/2000 | Mitsumori | 430/58.8 |

FOREIGN PATENT DOCUMENTS

| | | | | |
|---|---|---|---|---|
| JP | 05-165244 | * | 7/1993 | 430/66 |

OTHER PUBLICATIONS

Jap 10 Abstract of JP 05–165244, pub Jul. 2, 1993.*
U.S. Trademark Electronic Search System (TESS) Search of Panlite, which was registered Aug. 4, 1987.*
Derwent Machine–Assisted Translation of JP 5–165244 (pub 7/93).*
JPO Abstract of JP 08006450A, Jan. 12, 1996.
JPO Abstract of JP 08062862A, Mar. 8, 1996.
JPO Abstract of JP 06342236 A, Dec. 13, 1994.
JPO Abstract of JP 09081001A, Mar. 28, 1997.
JPO Abstract of JP 08272198A, Oct. 18, 1996.
JPO Abstract oF JP 04287052A, Oct. 12, 1992.
JPO Abstract of JP 05165384A, Jul. 2, 1993.

* cited by examiner

*Primary Examiner*—Janis L. Dote
(74) *Attorney, Agent, or Firm*—Oblon, Spivak, McClelland, Maier & Neustadt, P.C.

(57) ABSTRACT

An electrophotographic photoreceptor including an electroconductive substrate and a photoreceptive layer, which is formed overlying the substrate, wherein the photoreceptive layer includes a charge carrier generation layer including a charge carrier generation material and a charge carrier transport layer including a charge carrier transport material, and wherein when an electric field of from $2.5\times10^5$ V/cm to $5.5\times10^5$ V/cm is applied to the charge carrier transport layer, the relationship, $t_{CTL}/\mu_{CTL} \leqq 1.5\times10^3$ V·s/m, is satisfied, wherein $t_{CTL}$ represents a thickness of the charge carrier transport layer and $\mu_{CTL}$ represents a charge mobility of the charge carrier transport layer.

18 Claims, 2 Drawing Sheets

ELECTROPHOTOGRAPHIC PHOTORECEPTOR AND ELECTROPHOTOGRAPHIC IMAGE FORMING METHOD AND APPARATUS USING THE PHOTORECEPTOR

BACKGROUND OF THE INVENTION

1. Field of the Invention

The present invention relates to an electrophotographic photoreceptor, and to an electrophotographic image forming method and apparatus using the photoreceptor.

2. Discussion of the Background

Electrophotographic image forming methods such as Carlson process and modified process thereof have been widely used for image forming apparatus such as copiers and printers. Among the photoreceptors used for these image forming apparatus, organic photoreceptors are widely used because of being low-priced and pollution-free, and having good productivity.

Organic photoreceptors are broadly classified into photoconductive resin type photoreceptors including a photoconductive resin such as polyvinylcarbazole (PVK); charge-transfer complex type photoreceptors including, for example, PVK-TNF (2,4,7-trinitrofluorenone); pigment-dispersed type photoreceptors in which a pigment such as phthalocyanine pigments is dispersed in a resin; and functionally-separated photoreceptors including a combination of a charge carrier generation material and a charge carrier transport material. In particular, the functionally-separated photoreceptors attract considerable attention and are widely used.

The mechanism of formation of electrostatic latent images on a typical functionally-separated organic photoreceptor having a photoreceptive layer including a charge carrier generation layer and a charge carrier transport layer are as follows:

(1) when a charged photoreceptor is exposed to imagewise light, the light is absorbed by a charge carrier generation material included in the charge carrier generation layer;

(2) the charge carrier generation material that has absorbed light generates charge carriers;

(3) the charge carriers are injected into a charge carrier transport material included in the charge carrier transport layer; and (4) the injected charge carriers are transported through the charge carrier transport layer by an electric field caused by the charging of the photoreceptor, and finally neutralize the charge formed on the surface of the photoreceptor, resulting in formation of an electrostatic latent image on the photoreceptor.

Organic photoreceptors preferably have the following properties:

(1) good charge properties, i.e., formability of high electric potential and good charge maintaining ability;

(2) good potential decay properties when exposed to light, i.e., high photosensitivity and low residual potential;

(3) good spectral properties;

(4) good mechanical strength; and (5) good chemical resistance to heat, light, gases caused by charging such as ozone and NOX.

Recently, small-size image forming apparatus are desired, and therefore the diameter of photoreceptors becomes smaller and smaller. In addition, recently high speed digital image forming apparatus in which laser light is used as a light source of an imagewise light irradiation device have been developed and used. Therefore, the time during which a photoreceptor is exposed to imagewise light also becomes shorter and shorter. Therefore a need exists for a photoreceptor having high photoresponse.

In order to prepare a photoreceptor having high photoresponse, designing of proper formulation of the photoreceptive layer is important as well as development of high sensitive photoconductive materials. However, investigation of the formulation of the photoreceptive layer has not been satisfactorily performed. In addition, it has not been performed to establish the method of evaluating photoresponse of photoreceptors.

Japanese Laid-Open Patent Publications Nos. 8-6450 and 8-62862 have disclosed photoreceptors useful for high speed image recording, which include an organic charge carrier transport material having a charge mobility in a specified range. However, when the factor of thickness of the charge carrier transport layer is not considered, a problem in which resolution of the resultant images deteriorates or the resultant photoreceptor does not have high photoresponse tends to occur.

Further, recently long-life photoreceptors are also desired even when the thickness of the photoreceptors is relatively thin to effectively produce images having good resolution. Therefore, the durability (i.e., resistance to abrasion) of photoreceptors becomes more important. In general, organic materials used for photoreceptive layers have poor resistance to abrasion, and therefore a photoreceptor having good resistance to abrasion has not been obtained yet.

Japanese Laid-Open Patent Publications Nos. 4-287052 and 5-165384 have disclose photoreceptors which include a component capable of decreasing the friction coefficient of the photoreceptors. In addition, Japanese Laid-Open Patent Publications Nos. 6-342236 and 9-81001 have disclose image forming apparatus in which a device applying a component, which decreases the friction coefficient of the photoreceptor thereof, is provided. However, these techniques have not been applied to a photoreceptor used for high speed recording.

Japanese Laid-Open Patent Publication No. 8-272198 discloses an image forming apparatus in which the charge mobility of the photoreceptive layer, the thickness of the photoreceptive layer, the moving speed of the image bearing member configured to face the photoreceptor, and the electric field formed in the photoreceptive layer are set at proper values so as to satisfy a specific relationship to avoid formation of tailing of images. However, the image forming apparatus having such a structure cannot perform high speed recording.

Because of these reasons, a need exists for a photoreceptor which can exhibit an excellent combination of high photoresponse and good durability so as to be used for high speed image forming apparatus.

SUMMARY OF THE INVENTION

Accordingly, an object of the present invention is to provide a photoreceptor which can exhibit an excellent combination of high photoresponse and good durability so as to be used for high speed image forming apparatus.

Another object of the present invention is to provide an image forming method and apparatus which can produce good images at a high speed even upon use of a photoreceptor for a long period of time.

To achieve these objects, the present invention contemplates the provision of an electrophotographic photoreceptor including an electroconductive substrate and a photoreceptive layer, which is formed overlying the substrate, wherein the photoreceptive layer includes a charge carrier generation layer including a charge carrier generation material and a charge carrier transport layer including a charge carrier transport material, and wherein when an electric field of from $2.5\times10^5$ V/cm to $5.5\times10^5$ V/cm is applied to the charge carrier transport layer, the following relationship is satisfied:

$$t_{CTL}/\mu_{CTL} \leqq 1.5\times10^3 \text{ V·s/m}$$

wherein $t_{CTL}$ represents a thickness of the charge carrier transport layer and $\mu_{CTL}$ represents a charge mobility of the charge carrier transport layer.

The charge carrier transport material preferably includes a high-molecular-weight charge carrier transport material.

In addition, the surface of the photoreceptor preferably has a friction coefficient not greater than 0.5.

Another aspect of the present invention is to provide an electrophotographic image forming method including the steps of charging the photoreceptor mentioned above, irradiating the charge photoreceptor with imagewise light to form an electrostatic latent image, and developing the latent image with a developer to form a visible image.

Yet another aspect of the present invention is to provide an electrophotographic image forming apparatus (process cartridge) including at least the photoreceptor mentioned above, a charging device, an imagewise light irradiating device, a developing device, an image transferring device and an image fixing device. The apparatus preferably has a friction coefficient controlling device which controls a friction coefficient of a surface of the photoreceptor preferably by applying a lubricant to the surface of the photoreceptor These and other objects, features and advantages of the present invention will become apparent upon consideration of the following description of embodiments of the present invention in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like of corresponding parts throughout and wherein.

DETAILED DESCRIPTION OF THE INVENTION

The present inventors have investigated organic photoreceptors to achieve the objects mentioned above. As a result, it is discovered that a photoreceptor having high photoresponse can be obtained by imparting to a charge carrier transport layer a property such that when an electric field of from $2.5\times10^5$ V/cm to $5.5\times10^5$ V/cm is applied to the charge carrier transport layer, the following relationship is satisfied in the charge carrier transport layer:

$$t_{CTL}/\mu_{CTL} 23\ 1.5\times10^3\ V\cdot s/m$$

wherein $t_{CTL}$ represents a thickness of the charge carrier transport layer and $\mu_{CTL}$ represents a charge mobility of the charge carrier transport layer.

The photoreceptor of the present invention has good surface potential decay properties even when a short-pulse light is radiated thereto to form an electrostatic latent image, and therefore can be satisfactorily used for high speed electrophotographic recording.

In addition, it is also discovered that by including a lubricant in a surface layer of the photoreceptor, the resultant photoreceptor has good resistance to abrasion (i.e., good durability).

Further, by providing a friction coefficient controlling device in an electrophotographic image forming apparatus (or process cartridge), good images can be produced even upon use of the photoreceptor of the present invention for a long period of time.

Figure 1:
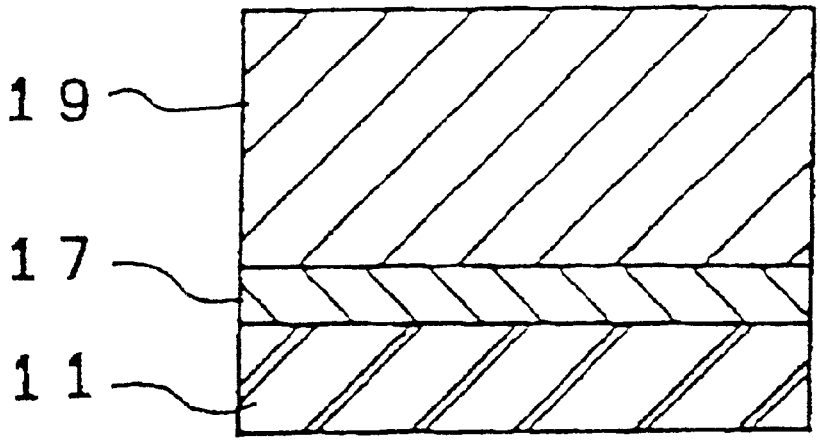
FIG. 1 is a schematic view illustrating a cross section of an embodiment of the photoreceptor of the present invention.
Figure 2:
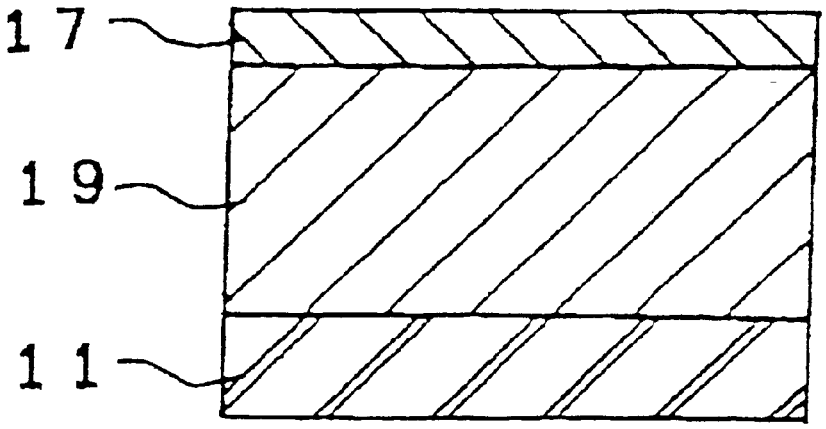
FIG. 2 is a schematic view illustrating a cross section of another embodiment of the photoreceptor of the present invention.

FIG. 1 is a schematic view illustrating a cross section of an embodiment of the photoreceptor of the present invention. In FIG. 1, a multi-layer photoreceptor is illustrated in which a charge carrier generation layer 17 is formed on an electroconductive substrate, and a charge carrier transport layer 19 is formed on the charge carrier generation layer 17. In FIG. 2, a charge carrier transport layer 19 is formed on an electroconductive substrate 11, and a charge carrier generation layer is formed on the charge carrier transport layer 19. In the present invention, the combination of the charge carrier generation layer 17 and charge carrier transport layer 19 is hereinafter referred to as a photoreceptive layer.

The thickness of the photoreceptive layer, particularly the thickness of the charge carrier transport layer, largely influences the resolution of the formed images. For example, in a negative-charge type multi-layer photoreceptor having the structure as shown in FIG. 1, positive and negative carriers are formed in the charge carrier generation layer 17 by irradiation of light. Among these carriers, negative carriers (i.e., electrons) are absorbed by the substrate 11. On the contrary, the positive carriers (i.e., positive holes) move through the charge carrier transport layer 19, and finally recombine with the electrons on the surface of the photoreceptor, resulting in decrease of the surface potential of the photoreceptor. By this recombination of positive holes and electrons, the electric field, which causes the positive holes to move to the surface of the photoreceptor, decreases gradually. Therefore, the positive holes tend to move toward the portion of the photoreceptor which is not exposed to light. This phenomenon, which is referred to as diffusion of carriers toward the surface of the photoreceptor, causes the resolution of latent images to deteriorate. To thin the charge carrier transport layer 19 is effective for maintenance of good resolution.

In addition, laser light is currently used for imagewise light irradiation. Laser light used for imagewise light irradiation has a photon flux of about $10^7$ times that of the light radiated by a halogen lamp conventionally used for this use. Therefore, the density of carrier generated in the charge carrier generation layer extremely increases, and the electric field of the charge carrier transport layer is decreased by the carrier moved from the charge carrier generation layer. In addition, the moving speed of the carriers is influenced by the irradiation of laser light, and the carriers, which are generated in an area of the charge carrier generation layer to which the central part of the laser light spot is radiated, tend to reach late the surface of the photoreceptor. The thus formed space charges cause the carriers to diffuse into the horizontal direction of the photoreceptive layer (i.e., a direction parallel to the surface of the photoreceptor), resulting in deterioration of resolution of latent images.

It is effective for preventing this diffusion of carriers to use a charge carrier transport material having a high charge mobility.

Suitable materials for use as the electroconductive substrate of the photoreceptor of the present invention includes a material having a volume resistivity less than $10^{10}$ Ω·m. Specific examples of such materials include drums and sheets which are made of plastics and paper and whose surfaces are coated with a metal such as aluminum, nickel, chrome, nickel-chrome alloys, copper, silver, gold, platinum and the like, or a metal oxide such as tin oxide and indium oxide, by a vacuum deposition method or a sputtering method. In addition, a plate of a metal such as aluminum, aluminum alloys, nickel, stainless steel and the like and a tube which is made, for example, by preparing a rough tube of a metal mentioned above by an extruding or a drawing method and then treating the surface of the rough tube by cutting, super finishing and/or polishing can also be used as a substrate.

The charge carrier generation layer 17 includes a charge carrier generation material as a main component.

Suitable charge carrier generation materials include organic materials such as monoazo pigments, disazo pigments, trisazo pigments, perylene type pigments, perynone type pigments, quinacridone type pigments, quinone type condensed polycyclic compounds, squaric acid type dyes, phthalocyanine type pigments, naphthalocyanine type pigments, and azulenium salt type dyes; and inorganic compounds such as selenium, selenium-tellurium selenium-arsenic alloys, and amorphous silicon.

These compounds are used alone or in combination.

The charge carrier generation layer 17 can be formed by coating a coating liquid, which is prepared by dispersing or dissolving one or more charge carrier generation materials in a proper solvent, if desired, together with a binder resin, using a ball mill, an attritor, a sand mill or the like dispersing device, and then drying the coated liquid.

Suitable coating methods include dip coating methods, spray coating methods, bead coating methods and the like coating methods.

Specific examples of the binder resins for use in the charge carrier generation layer 15 include polyamide resins, polyurethane resins, polyester resins, epoxy resins, polyketone resins, polycarbonate resins, silicone resins, acrylic resins, polyvinyl butyral resins, polyvinyl formal resins, polyvinyl ketone resins, polystyrene resins, polyacrylamide resins, and the like resins.

Suitable solvents for use in the charge carrier generation layer coating liquid include tetrahydrofuran, cyclohexanone, dioxane, 2-butanone, dichloroethane, and the like solvents.

The content of the binder resin in the charge carrier generation layer 17 is from 0 to 2 parts by weight per 1 part by weight of the charge carrier generation material included in the charge carrier generation layer 17.

The thickness of the charge carrier generation layer 17 is from 0.01 to 5 μm, and preferably from 0.1 to 2 μm.

The charge carrier generation layer 17 can also be formed by any known vacuum film forming method.

The charge carrier transport layer 19 can be formed by coating a coating liquid in which a charge carrier transport material and a binder resin are dissolved or dispersed in a proper solvent, and drying the coated liquid. Additives such as plasticizers, leveling agents and antioxidants can also be included in the coating liquid if desired.

Among the charge carrier transport materials, low-molecular-weight charge carrier transport materials are classified into positive-hole transporting materials and electron transporting materials.

Specific examples of the electron transporting materials include electron accepting materials such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-indeno-4H-indeno[1,2-b]thiophene-4-one, 1,3,7-trinitrodibenzothiophene-5,5-dioxide, and the like.

Specific examples of the positive-hole transporting materials include electron donating materials such as oxazole derivatives, oxadiazole derivatives, imidazole derivatives, triphenyl amine derivatives, 9-(p-diethylaminostyrylanthracene, 1,1-bis-(4-dibenzylaminophenyl)propane, styryl anthracene, styryl pyrazoline, phenyl hydrazone compounds, a-phenyl stilbene derivatives, thiazole derivatives, phenazine derivatives, acridine derivatives, benzofuran derivatives, benzimidazole derivatives, thiophene derivatives and the like. These positive-hole transport materials are used alone or in combination.

The charge carrier transport layer 19 can also be formed by coating a coating liquid, in which a high-molecular-weight charge carrier transport material is dissolved or dispersed in a proper solvent, and then drying the coated liquid. The high-molecular-weight charge carrier transport material includes known materials in which one or more of the charge transport substituents included in the low-molecular-weight charge carrier transport materials mentioned above are included in a main chain or a side chain of a high-molecular-weight material. In addition, the charge carrier transport layer of this type may include a binder resin, a low-molecular-weight charge carrier transport material, a plasticizer, a leveling agent, a lubricant and the like in a proper amount, if desired.

Specific examples of the binder resins for use in the charge carrier transport layer 19 include thermoplastic resins and thermosetting resins such as polystyrene resins, styrene-acrylonitrile copolymers, styrene-butadiene copolymers, styrene-maleic anhydride copolymers, polyester resins, polyvinyl chloride resins, vinyl chloride-vinyl acetate copolymers, polyvinyl acetate resins, polyvinylidene chloride resins, polyarylate resins, phenoxy resins, polycarbonate resins, cellulose acetate resins, ethyl cellulose resins, polyvinyl butyral resins, polyvinyl formal resins, polyvinyl toluene resins, acrylic resins, silicone resins, epoxy resins, melamine resins, urethane resins, phenolic resins, alkyd resins, and the like.

Specific examples of the solvent for use in the charge carrier transport layer coating liquid include tetrahydrofuran, dioxane, toluene, 2-butanone, monochlorobenzene, dichloroethane, methylene chloride, and the like solvents.

The charge carrier transport layer 19 may includes a plasticizer and a leveling agent.

Specific examples of the plasticizer include known plasticizers, which are used as a plasticizer for general resins, such as dibutyl phthalate, dioctyl phthalate, and the like plasticizers. The addition amount of the plasticizer in the charge carrier transport layer 19 is 0 to 30% by weight of the binder resin used.

Specific examples of the leveling agent include silicone oils such as dimethyl silicone oils and methyl phenyl silicone oils, and polymers and oligomers including a perfluoroalkyl group in their side chains. The addition amount of the leveling agent is from 0 to 1% by weight of the binder resin included in the charge carrier transport layer 19.

The thickness of the charge carrier transport layer 19 is preferably from 5 to 30 μm. The thickness is determined depending on the desired characteristics of the photoreceptor.

The content of the charge carrier transport material in the charge carrier transport layer 19 is not less than 40% by weight. When the content is less than 40% by weight, the charge formed on the resultant photoreceptor cannot sufficiently be decayed by exposure of pulsed light having a pulse width not greater than 5 μm. Namely the photoreceptor cannot be used for high speed electrophotographic image forming apparatuses.

When the charge carrier transport material is a high-molecular-weight charge carrier transport material, the substituents having a charge transporting function are preferably included in the charge carrier transport layer in an amount of not less than 40% by weight.

The charge mobility of the charge carrier transport layer 19 is preferably controlled so as to be not less than $3\times10^{-5}$ $cm^2/V\cdot s$ when an electric field of from $2.5\times10^5$ to $5.5\times10^5$ V/cm is applied to the charge carrier transport layer. The charge mobility can be obtained by a known TOF method. Namely, a film of a charge carrier transport layer of about 7.5 μm thick is formed on a polyester film having an aluminum electrode. Then a gold electrode of about 250 Å thick is formed thereon to prepare a sample to be measured. Laser light is radiated from the aluminum electrode side using a nitrogen pulse laser as a light source, and the charge mobility is calculated by the transitional photo-current detected. The measurement is performed at room temperature (25° C.).

In addition, the charge mobility of a charge carrier transport layer of a multi-layer photoreceptor consisting of a charge carrier generation layer and the charge carrier transport layer can be measured by a Xerographic Time of Flight method (XTOF). In detailed description, a photoreceptor to be measured is exposed to pulse light having a pulse width not greater than 5 μs in half width, which is radiated by a xenon flash lamp, while the surface potential of the photoreceptor is measured by a high speed surface potential meter (TREK 362A) The charge mobility can be determined by the surface potential decay curve soon after the light is radiated to the photoreceptor.

The electrophotographic photoreceptor may include an undercoat layer between the electroconductive substrate 11 and a photoreceptive layer. The undercoat layer includes a resin as a main component. Suitable resins for use in the undercoat layer include resins which have good resistance to general organic solvents because the photoreceptive layer coating liquid is coated on the undercoat layer to form the photoreceptive layer thereon.

Specific examples of such resins include water-soluble resins such as polyvinyl alcohol, casein, polyacrylic acid sodium salt, and the like resins; alcohol-soluble resins such as nylon copolymers, methoxymethylated nylons and the like; and crosslinking resins, which can form a three-dimensional network structure, such as polyurethane resins, melamine resins, alkyd-melamine resins, epoxy resins and the like.

The undercoat layer may include a particulate metal oxide such as titanium oxide, silica, aluminum oxide, zirconium oxide, tin oxide, indium oxide and the like to prevent occurrence of moiréin recorded images and to decrease the residual potential of the photoreceptor. The undercoat layer can be formed by a coating method similar to the method of forming the photoreceptive layer.

In addition, a metal oxide layer, which is formed by, for example, a sol-gel method using a silane coupling agent, a titanium coupling agent, a chromium coupling agent or the like, can also be used as the undercoat layer.

Further, an alumina layer which is formed by an anodic oxidation method, and a layer which is formed by depositing an organic material such as polyparaxylylene or an inorganic material such as SiO, $SnO_2$, $TiO_2$, ITO, $CeO_2$, and the like by a vacuum thin film forming method can also be used as the undercoat layer.

The thickness of the undercoat layer is preferably from 0 to 5 μm.

In the present invention, a protective layer is formed on the photoreceptive layer to protect the photoreceptive layer.

Specific examples of the materials for use in the protective layer include ABS resins, ACS resins, olefin-vinyl monomer copolymers, chlorinated polyether resins, aryl resins, phenolic resins, polyacetal resins, polyamide resins, polyamideimide resins, polyacrylate resins, polyarylsulfone resins, polybutylene resins, polybutyleneterephthalate resins, polycarbonate resins, polyethersulfone resins, polyethylene resins, polyethyleneterephthalate resins, polyimide resins, acrylic resins, polymethylpentene resins, polypropylene resins, polyphenylene oxide resins, polysulfone resins, As resins, AB resins, BS resins, polyurethane resins, polyvinyl chloride resins, polyvinylidene chloride resins, epoxy resins and the like.

The protective layer may include a lubricating resin such as fluorine-containing resins like polytetrafluoroethylene and silicone resins to improve the abrasion resistance of the photoreceptor. In addition, an inorganic material such as titanium oxides, tin oxides, potassium titanate and the like may be dispersed in the lubricating resins.

The protective layer can be formed by a general coating method. The thickness of the protective layer is preferably from 0.5 to 10 μm.

In addition, the protective layer can be formed by depositing i-C, a-SiC and the like material by a vacuum thin film forming method.

In the present invention, an intermediate layer may be formed between the photoreceptive layer and the protective layer. The intermediate layer includes a resin as a main component. Specific examples of the resin include polyamide resins, alcohol-soluble nylon resins, water-soluble polyvinyl butyral resins, polyvinyl butyral resins, polyvinyl alcohols, and the like resins. The intermediate layer can be formed by any one of the known coating methods mentioned above. The thickness of the intermediate layer is preferably from 0.05 to 2 μm.

In the photoreceptor of the present invention, a lubricant is preferably included at least in a top layer, i.e., the farthest layer from the electroconductive substrate 11, together with the charge carrier transport material to enhance the friction coefficient, water-repelling ability and releasability of the photoreceptor.

Specific examples of the lubricant include fluorine-containing oils such as perfluoropolyether oils having a linear structure. The average molecular weight thereof is preferably from 2000 to 9000. The fluorine-containing oils are used alone or in combination. The content of the fluorine-containing oil in the top layer of the photoreceptor is preferably from 0.1 to 5% by weight to exert its effect and not to deteriorate good film formability of the top layer. In addition, silicone oils, metal soaps and fluorine-containing resins can also be used as a lubricant.

Next the way how to improve the durability of a photoreceptor will be explained.

In order to improve the durability of a photoreceptor for use in the image forming method in which a photoreceptor is subjected to at least processes of charging, imagewise light irradiation, developing, toner image transferring, and fixing, the abrasion of the photoreceptor has to be controlled so as to be as small as possible.

When the photoreceptive layer is abraded too much, the electric properties of the photoreceptor such as charging properties, and surface potential decay properties caused by light irradiation change. When the electric properties of the photoreceptor change, good images cannot be obtained when the charging and imagewise light irradiation processes are performed under the predetermined conditions.

The abrasion of the photoreceptor occurs at positions at which the photoreceptor contacts other members of the image forming apparatus. Among these members, the cleaning unit, which removes the toner particles remaining on the photoreceptor with a blade or a brush, abrades the photoreceptor more seriously than the other members. The abrasion of the photoreceptor caused by the cleaning unit is classified into two types.

One of the types is abrasion caused by shear stress generated between the blade (or brush) and the photoreceptor. Another type is abrasion caused by the residual toner particles which are present between the photoreceptor and the blade (or brush) of the cleaning unit. The toner particles abrade the photoreceptor while serving like a grinding stone.

The abrasion of the photoreceptor depends on the factors such as the mechanical strength of the photoreceptor, the contact pressure of the blade (or brush), the hardness of the toner particles and the friction coefficient ($\mu$) of the photoreceptor. In particular, there is a correlation between the shear stress at the contact portion of the photoreceptor with the blade (or brush) and the friction coefficient of the surface of the photoreceptor. Therefore, by controlling the friction coefficient of the surface of the photoreceptor so as to be relatively low, the abrasion of the photoreceptor can be improved.

One of the methods of controlling the friction coefficient of the surface of the photoreceptor is to include a lubricant in the top layer as mentioned above.

Another method of controlling the friction coefficient of the surface of the photoreceptor is to supply a lubricant material on the surface of the photoreceptor when the photoreceptor is used in an image forming apparatus. The lubricant material can be applied to the surface of the photoreceptor using a brush roller, an elastic roller, an elastic blade, a brush, a belt and the like member. Contact charging members in the image forming apparatus and transfer members can serve as the lubricant supplying member.

Suitable materials for use as the lubricant, which is applied to the surface of the photoreceptor, include liquid, solid or powdery lubricating materials. When a solid lubricating material is used, the lubricating material itself can serve as the lubricant supplying member.

Specific examples of the lubricant to be supplied to the surface of the photoreceptor include lubricating liquids such as silicone oils, fluorine-containing oils and the like oils; and lubricating solids and powders such as fluorine-containing resins, e.g., polytetrafluoroethylene (PTFE), perfluoroalkylvinyl ether (PFA) and polyvinylidene fluoride (PVDF), silicone resins, polyolefin resins, silicone greases, fluorine-containing greases, paraffin waxes, fatty acid metal salts such as zinc stearate, graphite, molybdenum disulfide and the like.

The friction coefficient of the surface of the photoreceptor is preferably controlled so as to be not greater than 0.5 when measured by an Euler belt method. When the friction coefficient is too low, i.e., less than about 0.1 and typically less than about 0.05, good toner images cannot be formed on the photoreceptor because the adhesion of the toner particles with the photoreceptor seriously decreases. In particular, this problem tends to occur in an image forming apparatus in which a latent image is developed with a two-component developer while the developer contacts the surface of the photoreceptor. Namely, the toner images, which are once formed on the photoreceptor, tend to be scraped by being further rubbed with the ears of the developer, resulting in movement of the position of the toner images, and/or occurrence of tailing of the toner images. Therefore the friction coefficient should be carefully controlled to avoid such problems.

The Euler belt method will be explained in detail referring to FIG. 3.

Figure 3:
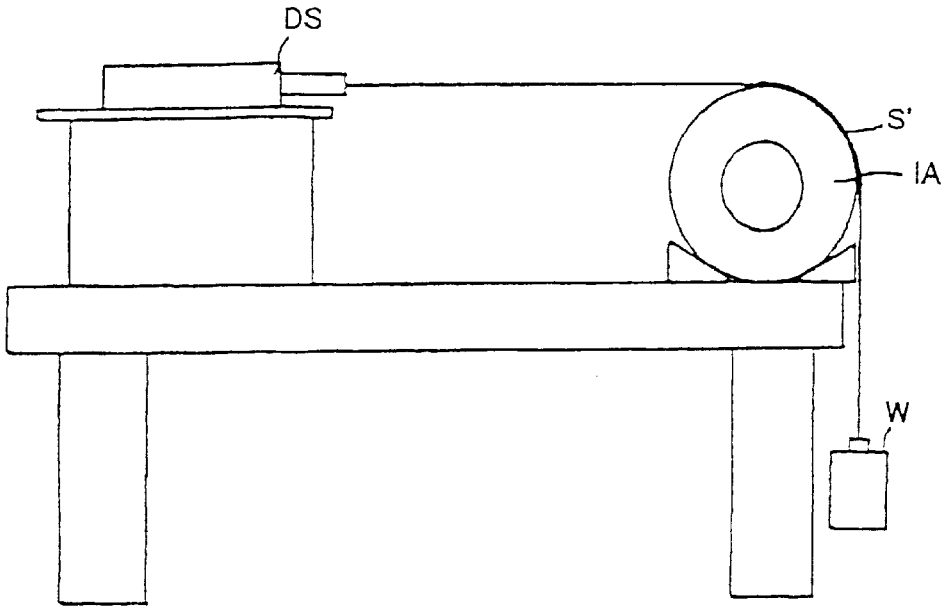
FIG. 3 is a schematic view illustrating an instrument useful for measuring friction coefficient of a photoreceptor according to an Euler method.

In FIG. 3, character S' denotes a paper to be measured which have a middle thickness and a dimension of 30 mm in width and 250 mm in length. Two hooks are set at each longitudinal end of the paper S', and a load w (100 g) is set at one hook and a digital force gauge DS is set at the other hook. The paper S' is set in the measuring instrument so as to contact a photoreceptor 1A, as shown in FIG. 3. The paper S' is pulled with the digital force gauge DS. Provided when a force at which the paper S' starts to move is F, the coefficient of static friction of the photoreceptor 1A is determined by the following equation (1):

$$\mu=(2/\pi)\times\ln(F/w) \tag{1}$$

wherein $\mu$ is the coefficient of static friction of the photoreceptor 1A, F is the measured value of the force, and w is the load (gram-force).

Figure 4:
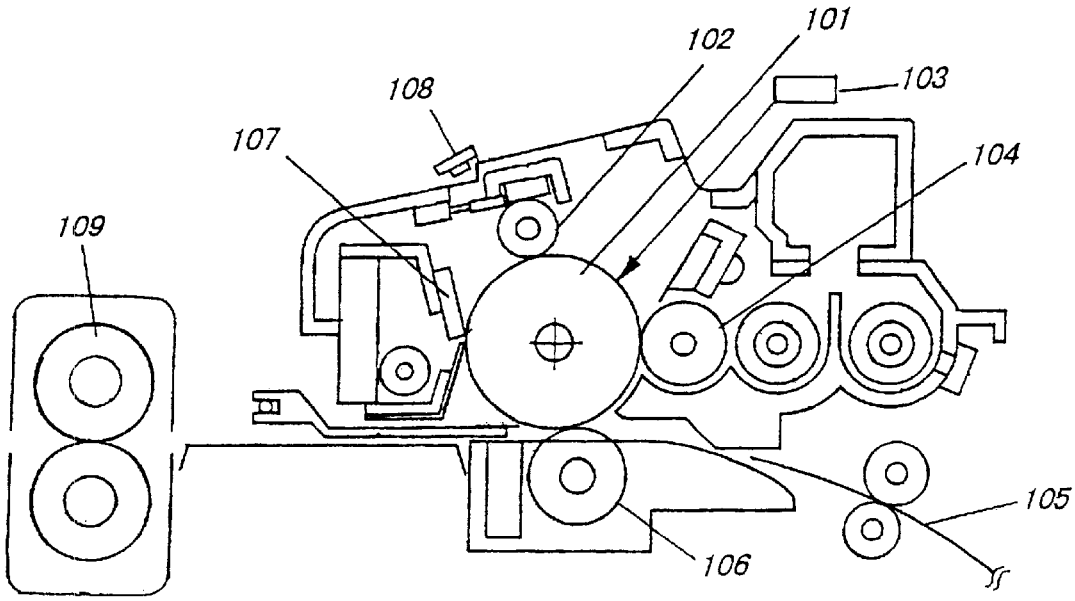
FIG. 4 is a schematic view illustrating an embodiment of the image forming process cartridge of the present invention.

FIG. 4 is a schematic view illustrating an image forming apparatus useful for the image forming method of the present invention. In FIG. 4, a photoreceptor 101 is charged by a charger 102 so as to be entirely charged. The charged photoreceptor 101 is exposed to imagewise light radiated by a light irradiating device 103 to form an electrostatic latent image on the photoreceptor 101. The electrostatic latent image is developed by a developing device 104 to form a toner image on the photoreceptor 101. The toner image is transferred onto a receiving material 105 at the nip of the photoreceptor 101 and a transfer device 106. The toner image transferred onto the receiving material 105 is fixed by a fixing device 109. Thus an image is formed.

The photoreceptor 101 is cleaned by a cleaning blade 107 and discharged by a charging lamp 108.

When a lubricant is applied to the photoreceptor by a lubricant applying member (i.e., a friction coefficient controlling member), the member is preferably provided between the cleaning blade 107 and the charger 102.

A process cartridge, in which a charging device, an imagewise light irradiating device, a developing device, a transfer device, a cleaning device and a discharging device are provided, may be provided in the image forming apparatus.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

(Formation of Charge Carrier Generation Layer)

A charge carrier generation layer, in which a charge carrier generation material having the following. formula (a) and a polyvinyl butyral resin (tradename of XYHL, manufactured by Union Carbide Corp.) were included in a ratio of 10:4 by weight was formed on an aluminum substrate such that the thickness thereof was 0.16 $\mu$m.

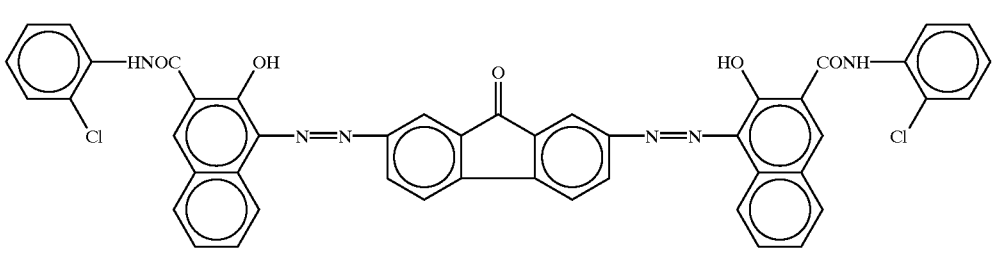

(Formation of Charge Carrier Transport Layer)

A charge carrier transport layer, in which a charge carrier transport material having the following formula (b) and a bisphenol type polycarbonate resin (trade name of PANLITE K-1300, manufactured by Teijin Ltd.) were included in a ratio of 1:1 by weight was formed on the charge carrier generation layer such that the thickness thereof was 10 $\mu$m.

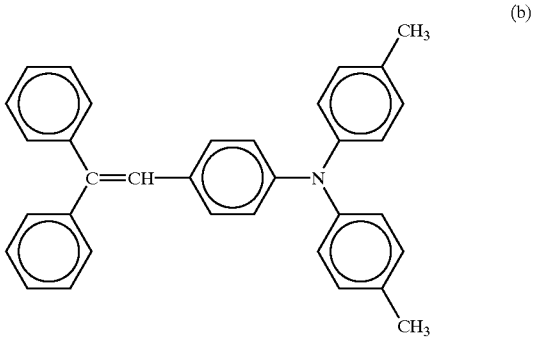

The thickness of the charge carrier transport layer was measured by sloan DEKTAK IIA as the difference from a standard plane. The electric field of the charge carrier transport layer can be calculated by the potential formed thereon and its thickness.

Thus a photoreceptor of the present invention was prepared.

(Evaluation Method)

(1) Photoresponse to Short Pulse Light (High Speed Response)

Photoresponse of the photoreceptor to short pulse light was measured using an electrostatic paper analyzer EPA8200 (manufactured by Kawaguchi Electric Works) and a Xenon flash lamp module C5604 which serves as a pulse light source and which could emit pulse light having a half width of 3 $\mu$s. The amount of light radiated to the photoreceptor was changed using an ND filter to obtain the surface potential decay properties of the photoreceptor. In detailed description, the photoreceptor was charged so as to have a potential of about −500 V and pulse light was radiated to the photoreceptor such that the potential decayed from −500 V to about −100 V. This surface potential decay curve of the photoreceptor was stored in a storage scope and then the time needed for decaying the initial potential (−500 V) to one-half (−250 V). This time is referred to as photoresponse of the photoreceptor.

As a result, the photoresponse of the photoreceptor of Example 1 was 0.08 ms. In addition, when the operation properties of the photoreceptor were checked using an electrophotographic process simulator, it was found that the photoreceptor could stably work at a speed of 200 mm/s.

(2) Copying Test

A photoreceptor, which was prepared by repeating the procedure for preparation of the photoreceptor in Example 1 except that the substrate was changed to an aluminum cylinder having a diameter of 60 mm, was set in an electrophotographic copier, modified IMAGIO MF4550 manufactured by Ricoh Co., Ltd., to perform a copying test. The time from the imagewise light irradiation process to the developing process was about 100 ms.

As a result, the photoreceptor produced images having good resolution. The resolution was 7.1 lines/mm. In addition, there was no abnormal image in the resultant images, such as background fouling caused by increase in residual potential of the light irradiated portion of the photoreceptor (i.e., background fouling caused by poor photosensitivity of the photoreceptor).

(3) Charge Mobility of Charge Carrier Transport Layer

The charge mobility of the charge carrier transport layer was also measured when the electric field was $4.5\times10^5$ V/cm.

As a result, the charge mobility in the charge carrier transport layer of the photoreceptor of Example 1 was $1\times10^{-4}$ $cm^2/V\cdot s$. The ratio of the thickness ($t_{CTL}$) to the charge mobility ($\mu_{CTL}$), $t_{CTL}/\mu_{CTL}$, was $1\times10^3$ V·s/m.

Example 2

A charge carrier generation layer, which consisted of a mixture of the charge carrier generation material having formula (a) described above and a charge carrier transport material having the following formula (c) in a ratio of 1:1 by weight, was formed on an aluminum substrate such that the thickness thereof was 0.21 $\mu$m. A charge carrier transport layer consisting of the charge carrier transport material having formula (c) was formed on the charge carrier transport layer such that the thickness thereof was 11 $\mu$m.

(c)

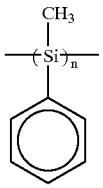

The photoresponse of the photoreceptor was 0.03 ms. In addition, when the operation properties of the photoreceptor were checked using the electrophotographic process simulator, it was found that the photoreceptor could stably work at a speed of 200 mm/s.

Further, when the cylindrical photoreceptor was set in the modified IMAGIO MF4550 to perform a copying test, the photoreceptor produced images having good resolution. The resolution was 6.3 lines/mm. In addition, there was no abnormal image in the resultant images, such as background fouling caused by increase in residual potential of the light irradiated portion of the photoreceptor (i.e., background fouling caused by poor photosensitivity of the photoreceptor).

The charge mobility of the charge carrier transport layer of the photoreceptor of Example 2 was $5\times10^{-4}$ $cm^2/V\cdot s$ under an electric field of $4.5\times10^5$ V/cm. The ratio of the thickness ($t_{CTL}$) to the charge mobility ($\mu_{CTL}$), $t_{CTL}/\mu_{CTL}$, was $2.2\times10^2$ V·s/m.

Thus, a multi-layer type photoreceptor of the present invention was prepared.

Example 3

The procedure for preparation of the charge carrier generation layer in Example 1 was repeated. Then a charge carrier transport layer, which consisted of a mixture of the charge carrier transport material having formula (b) and the charge carrier transport material having formula (c) in a ratio of 1:1 was formed on the charge carrier generation layer such that the thickness thereof was 9 $\mu$m.

The responsivity of the photoreceptor was 0.03 ms. In addition, when the operation properties of the photoreceptor were checked using the electrophotographic process simulator, it was found that the photoreceptor could stably work at a speed of 200 mm/s.

Further, when the cylindrical photoreceptor was set in the modified IMAGIO MF4550 to perform a copying test, the photoreceptor produced images having good resolution and the resolution of the images was 6.3 lines/mm. In addition, there was no abnormal image in the resultant images, such as background fouling caused by increase in potential of the light irradiated portion of the photoreceptor (i.e., background fouling caused by poor photosensitivity of the photoreceptor)

The charge mobility of the charge carrier transport layer of the photoreceptor of Example 3 was $2\times10^{-4}$ $cm^2/V\cdot s$ under an electric field of $4.5\times10^5$ V/cm. The ratio of the thickness ($t_{CTL}$) to the charge mobility ($\mu_{CTL}$), $t_{CTL}/\mu_{CTL}$, was $4.5\times10^2$ V·s/m.

Thus, a multi-layer type photoreceptor of the present invention was prepared.

Comparative Example 1

A charge carrier generation layer, which consisted of a mixture of a charge carrier generation material having the following formula (d) and a polyvinyl butyral resin (Trade name of XYHL, manufactured by Union Carbide Corp.) in a ratio of 3:1 by weight, was formed on an aluminum substrate such that the thickness thereof was, 0.2 $\mu$m.

(d)

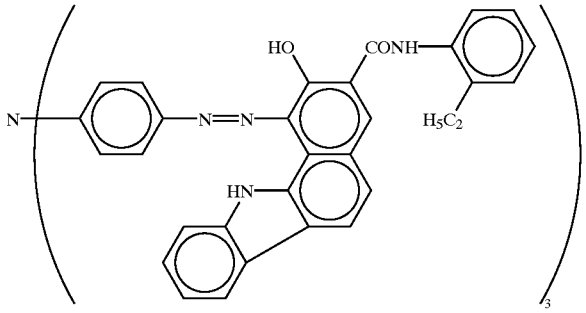

Then a charge carrier transport layer, which consisted of a mixture of the charge carrier transport material having formula (c) and a polycarbonate resin (Trade name of PANLITE K-1300, manufactured by Teijin ltd.) in a ratio of 1:1 by weight was formed thereon such that the thickness thereof was 20 $\mu$m.

The photoresponse of the photoreceptor was 1.2 ms. In addition, when the operation properties of the photoreceptor were checked using the electrophotographic process simulator, it was found that the photoreceptor could not work at a speed of 200 mm/s because the photoreceptor had poor photosensitivity.

The charge mobility of the charge carrier transport layer of the photoreceptor of Comparative Example 1 was $3\times10^{-5}$ $cm^2/V\cdot s$ under an electric field of $4.5\times10^5$ V/cm. The ratio of the thickness ($t_{CTL}$ ) to the charge mobility ($\mu_{CTL}$), $t_{CTL}/\mu_{CTL}$, was $6.7\times10^3$ V·s/m.

Thus, a comparative multi-layer type photoreceptor was prepared.

Comparative Example 2

The procedure for preparation of the photoreceptor in Example 1 was repeated except that the composition of the charge carrier transport layer was a mixture of the charge carrier transport material having formula (b) and a bisphenol type polycarbonate resin (PANLITE K-1300) in a ratio of 3:7 by weight, and the thickness of the charge carrier transport layer was changed to 19 $\mu$m.

The photoresponse of the photoreceptor was 2.5 ms. In addition, when the operation properties of the photoreceptor were checked using the electrophotographic process simulator, it was found that the photoreceptor could not work at a speed of 200 mm/s because the photoreceptor had poor photosensitivity.

The charge mobility of the charge carrier transport layer of the photoreceptor of Comparative Example 2 was $2\times10^{-5}$ $cm^2/V\cdot s$ under an electric field of $4.5\times10^5$ V/cm. The ratio of the thickness ($t_{CTL}$) to the charge mobility ($\mu_{CTL}$), $t_{CTL}/\mu_{CTL}$, was $9.5\times10^3$ V·s/m.

Thus, a comparative multi-layer type photoreceptor was prepared.

Example 4

A charge carrier generation layer, which consisted of a mixture of a charge carrier generation material consisting of an oxotitanium phthalocyanine pigment and a polyvinyl butyral resin (tradename of XYHL, manufactured by Union Carbide Corp.) in a ratio of 10:1 by weight, was formed on an aluminum substrate such that the thickness thereof was 0.2 $\mu$m.

Then a charge carrier transport layer consisting of a high-molecular-weight charge carrier transport material having the following formula (e) was formed thereon such that the thickness thereof was 11 $\mu$m.

(Evaluation Method)

(4) Abrasion Test

The photoreceptor was subjected to a rubbing test, in which stress was applied to the photoreceptor corresponding to the stress applied to the photoreceptor when the photoreceptor was run in a copier so that 100,000 copies were formed, using a rubbing tester.

After the abrasion test, the coefficient of friction between the photoreceptor and paper was not greater than 0.5.

(e)

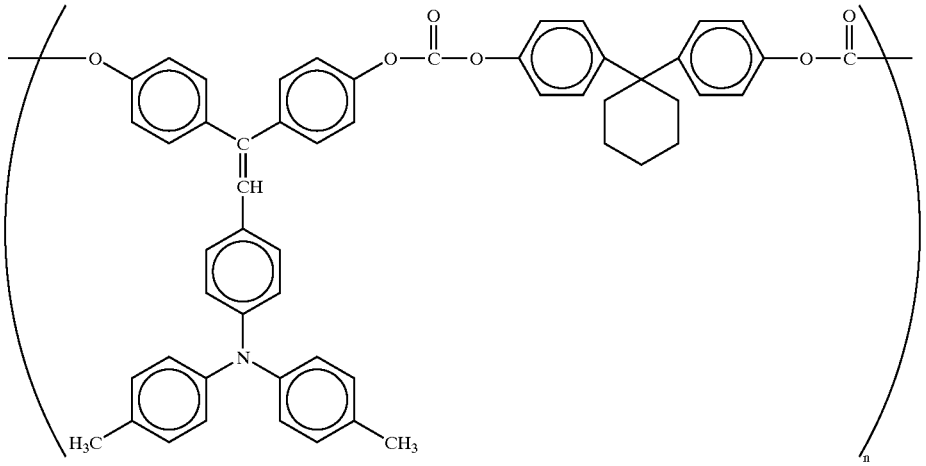

The photoresponse of the photoreceptor was 0.7 ms. In addition, when the operation properties of the photoreceptor were checked using the electrophotographic process simulator, it was found that the photoreceptor could work well at a speed of 200 mm/s because the photoreceptor had high photosensitivity.

Further, when the cylindrical photoreceptor was set in the modified IMAGIO MF4550 to perform a copying test, the photoreceptor produced images having good resolution. The resolution was 6.3 lines/mm. In addition, there was no abnormal image in the resultant images, such as background fouling caused by increase in potential of the light irradiated portion of the photoreceptor (i.e., background fouling caused by poor photosensitivity of the photoreceptor).

The charge mobility of the charge carrier transport layer of the photoreceptor of Example 4 was $1\times10^{-4}$ cm$^2$/V·s under an electric field of $4.5\times10^5$ V/cm. The ratio of the thickness ($t_{CTL}$) to the charge mobility ($\mu_{CTL}$), $t_{CTL}/\mu_{CTL}$, was $1.1\times10^3$ V·s/m.

Thus, a multi-layer type photoreceptor of the present invention was prepared.

Example 5

The procedure for preparation of the photoreceptor in Example 1 was repeated except that a fluorine-containing oil (perfluoropolyether oil tradenamed as DMUNUM™ GREASE S-100, manufactured by Daikin Industries Ltd.) was added to the charge carrier transport layer in an amount of 0.2% by weight.

The photoresponse of the photoreceptor was 0.25 ms. In addition, when the operation properties of the photoreceptor were checked using the electrophotographic process simulator, it was found that the photoreceptor could work well at a speed of 200 mm/s because the photoreceptor had high photosensitivity.

Example 6

The procedure for preparation of the photoreceptor in Example 2 was repeated except that a fluorine-containing oil (perfluoropolyether oil tradenamed as DEMNUM™ GREASE S-100, manufactured by Daikin Industries Ltd.) was added to the charge carrier transport layer in an amount of 0.2% by weight.

The photoresponse of the photoreceptor was 0.19 ms. In addition, when the operation properties of the photoreceptor were checked using an electrophotographic process simulator, it was found that the photoreceptor could work well at a speed of 200 mm/s because the photoreceptor had high photosensitivity.

In addition, after the abrasion test, the coefficient of friction between the photoreceptor and paper was not greater than 0.5.

Thus, a photoreceptor of the present invention was prepared.

Example 7

The procedure for preparation of the photoreceptor in Example 3 was repeated except that zinc stearate was added to the charge carrier transport layer in an amount of 0.3% by weight.

The photoresponse of the photoreceptor was 0.22 ms. In addition, when the operation properties of the photoreceptor were checked using the electrophotographic process simulator, it was found that the photoreceptor could work well at a speed of 200 mm/s because the photoreceptor had high photosensitivity.

In addition, after the abrasion test, the coefficient of friction between the photoreceptor and paper was not greater than 0.5.

Thus, a photoreceptor of the present invention was prepared.

Comparative Example 3

The photoreceptor of Comparative Example 1 was subjected to the abrasion test. The coefficient of friction between the photoreceptor and paper was not less than 0.6 even after an abrasion test corresponding to a 100-copies running test in a copier.

Comparative Example 4

The photoreceptor of Comparative Example 2 was subjected to the abrasion test. The coefficient of friction between the photoreceptor and paper was not less than 0.6 even after an abrasion test corresponding to a 100-copies running test in a copier.

Example 8

The procedure for preparation of the photoreceptor in Example 4 was repeated except that zinc stearate was added to the charge carrier transport layer in an amount of 0.3% by weight.

The responsivity of the photoreceptor was 0.83 ms. In addition, when the operation properties of the photoreceptor were checked using an electrophotographic process simulator, it was found that the photoreceptor could work well at a speed of 200 mm/s because the photoreceptor had high photosensitivity.

In addition, after the abrasion test, the coefficient of friction between the photoreceptor and paper was not greater than 0.5.

Thus, a photoreceptor of the present invention was prepared.

Example 9

The cylindrical photoreceptor of Example 1 was set in a copying tester, in which a member imparting low friction coefficient to the photoreceptor and always contacting the photoreceptor was provided between a cleaning unit and a charger. The member was constituted of a stainless substrate, an urethane foam (Trade name of LE20, manufactured by INOAC Corp.) formed on the stainless substrate, and a PTFE sheet (tradename of T/#9001, manufactured by Nichias Corp.) formed on the urethane foam.

Even after a running test, which corresponds to a running test of 100,000 copies in a copier, was performed using the copying tester, the coefficient of friction between the photoreceptor and paper was not greater than 0.5.

Example 10

The photoreceptor of Example 2 was subjected to the running test described in Example 9. Even after the running test, the coefficient of friction between the photoreceptor and paper was not greater than 0.5.

Example 11

The photoreceptor of Example 3 was subjected to the running test described in Example 9 except that the member imparting low friction coefficient to the photoreceptor was replaced with a member in which a "PTFE" powder (RUBRON L2 manufactured by Daikin Industries Ltd. ) was supplied to a brush to supply the powder to the photoreceptor while the brush was rotated in a direction opposite to the rotating direction of the photoreceptor.

Even after a running test, which corresponds to the running test of 100,000 copies in a copier, was performed using the copying tester, the coefficient of friction between the photoreceptor and paper was not greater than 0.5.

Example 12

The photoreceptor of Example 4 was subjected to the running test described in Example 11. Even after the running test, the coefficient of friction between the photoreceptor and paper was not greater than 0.5.

As can be understood from the above description, the photoreceptor of the present invention have so high photosensitivity that the photoreceptor can produce good image even when used for high speed copiers, because of having a property such that a ratio of the thickness (t) of the charge carrier transport layer to the charge mobility ($\mu$) thereof is not greater than $1.5\times10^3$. In addition, by including a lubricant in a top layer of the photoreceptor which is used for producing images having good resolution and which has a relatively thin photoreceptive layer, or by supplying a lubricant to the photoreceptor in a copier, the photoreceptor has good resistance to abrasion and therefore can produce good images even upon use for a long period of time.

Having now fully described the invention, it will be apparent to one of ordinary skill in the art that man changes and modifications can be made thereto without departing from the spirit and scope of the invention as set forth therein.

This application is based on Japanese Patent Application No. 11-037691, filed on Feb. 16, 1999, incorporated herein by reference.

What is claimed as new and desired to be Secured by Letters Patent of the United States is:

1. An electrophotographic photoreceptor, comprising:

an electroconductive substrate; and a photoreceptive layer overlying said substrate; wherein said photoreceptive layer comprises:

a charge carrier generation layer comprising a charge carrier generation material, and a charge carrier transport layer comprising a charge carrier transport material, and wherein when an electric field of $2.5\times10^5$ V/cm to $5.5\times10^5$ V/cm is applied to said charge carrier transport layer, the following relationship is satisfied:

$$t_{CTL}/\mu_{CTL} \leqq 10^2 V\cdot s/m$$

wherein $t_{CTL}$ represents a thickness of said charge carrier transport layer and $\mu_{CTL}$ represents a charge mobility of said charge carrier transport layer, and said charge carrier transport material of said charge carrier transport layer comprises an electron accepting material selected from the group consisting of chloranil, bromanil, tetracyanoethylene, tetracyanoquinodimethane, 2,4,7-trinitro-9-fluorenone, 2,4,5,7-tetranitroxanthone, 2,4,8-trinitrothioxanthone, 2,6,8-trinitro-indeno-4H-indeno[1,2-b]thiophene-4-one, and 1,3,7-trinitrodibenzothiophene-5,5-dioxide or a hole transporting material selected from the group consisting of 9-(p-diethylaminostyryl)anthracene, 1,1-bis-(4-dibenzylaminophenyl)propane, styryl anthracene, styryl pyrazoline, a compound of formula (b), and a compound of formula (e):

(b)

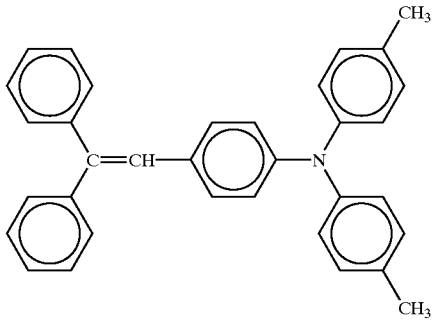

(e)

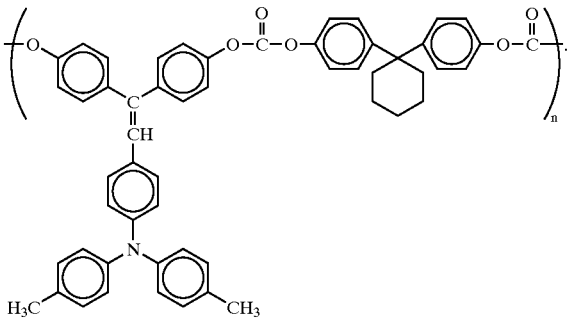

2. The electrophotographic photoreceptor according to claim 1, wherein said charge carrier transport material comprises a charge transport polymer material.

3. The electrophotographic photoreceptor according to claim 1, wherein said charge carrier transport layer overlies said charge carrier generation layer, and wherein said charge carrier transport layer further comprises a lubricant.

4. The electrophotographic photoreceptor according to claim 1, wherein said charge carrier transport layer has a friction coefficient of not greater than 0.5.

5. An electrophotographic image forming method, comprising:

charging an electrophotographic photoreceptor;

irradiating said charged photoreceptor with imagewise light to form an electrostatic latent image on said photoreceptor; and developing said electrostatic latent image with a developer to form a visible image on said photoreceptor;

wherein said photoreceptor comprises:

an electroconductive substrate; and a photoreceptive layer overlying said substrate;

wherein said photoreceptive layer comprises;

a charge carrier generation layer comprising a charge carrier generation material, and a charge carrier transport layer comprising a charge carrier transport material, and wherein when an electric field of $2.5\times10^5$ V/cm to $5.5\times10^5$V/cm is applied to said charge carrier transport layer, the following relationship is satisfied:

$$t_{CTL}/\mu_{CTL} \leq 2.2\times10^2 \text{ V·s/m}$$

wherein $t_{CTL}$ represents a thickness of said charge carrier transport layer and $\mu_{CTL}$ represents a charge mobility of said charge carrier transport layer, and said charge carrier transport material of said charge carrier transport layer comprises an electron accepting material selected from the group consisting of chloranil, bromanil, tetracyanoethylene, tetracyanoquinodimethane, 2,4,7-trinitro-9-fluorenone, 2,4,5,7-tetranitroxanthone, 2,4,8-trinitrothioxanthone, 2,6,8-trinitro-indeno-4H-indeno[1,2-b]thiophene-4one, and 1,3,7-trinitrodibenzothiophene-5,5-dioxide or a hole transporting material selected from the group consisting of 9-(p-diethylaminostyryl)anthracene, 1,1-bis-(4-dibenzylaminophenyl)propane, styryl anthracene, styryl pyrazoline, a compound of formula (b), and a compound of formula (e):

(b)

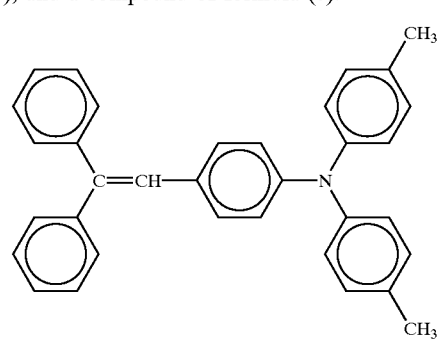

(e)

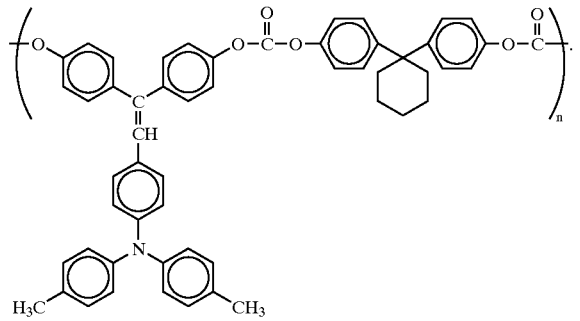

6. The electrophotographic image forming method according to claim 5, wherein said charge carrier transport material comprises a charge transport polymer material.

7. The electrophotographic image forming method according to claim 5, wherein said charge carrier transport layer overlies said charge carrier generation layer, and wherein said charge carrier transport layer further comprises a lubricant.

8. The electrophotographic image forming method according to claim 5, wherein said charge carrier transport layer has a friction coefficient of not greater than 0.5.

9. The electrophotographic image forming method according to claim 5, further comprising controlling a friction coefficient of a surface of said photoreceptor.

10. The electrophotographic image forming method according to claim 9, wherein said controlling comprises applying a lubricant to said surface of said photoreceptor.

11. The electrophotographic image forming method according to claim 9, wherein said friction coefficient of said surface of said photoreceptor is controlled so as to be not greater than 0.5.

12. An electrophotographic image forming process cartridge, comprising:

an electrophotographic photoreceptor;

a charger, which carries said photoreceptor;

an imagewise light irradiating device, which irradiates said photoreceptor with imagewise light to form an electrostatic latent image on said photoreceptor;

a developing device, which develops said latent image with a toner to form a toner image on said photoreceptor;

a transferring device, which transfers said toner image on said photoreceptor onto a receiving material;

a cleaning device, which cleans a surface of said photoreceptor; and a discharging device, which discharges a residual potential of said photoreceptor, wherein said photoreceptor comprises:

an electroconductive substrate; and a photoreceptive layer overlying said substrate;

wherein said photoreceptive layer comprises;

a charge carrier generation layer comprising a charge carrier generation material, and a charge carrier transport layer comprising a charge carrier transport material, and wherein when an electric field of $2.5\times10^5$ V/cm to $5.5\times10^5$ V/cm is applied to said charge carrier transport layer, the following relationship is satisfied:

$$t_{CTL}/\mu_{CTL} \leqq 2.2\times10^2 V\cdot s/m$$

wherein $t_{CTL}$ represents a thickness of said charge carrier transport layer and $\mu_{CTL}$ represents a charge mobility of said charge carrier transport layer, and said charge carrier transport material of said charge carrier transport layer comprises an electron accepting material selected from the group consisting of chloranil, bromanil, tetracyanoethylene, tetracyanonquinodimethane, 2,4,7-trinitro-9-fluorene, 2,4,5,7-tetranotroxanthone, 2,4,8-trinitrothioxanthone, 2,6,8-trinitro-indeno-4H-indeno[1,2-b]thiophene-4-one, and 1,3,7-trinitrodibenzothiophene-5,5-dioxide or a hole transporting material selected from the group consisting of 9-(p-diethylaminostyryl)anthracene, 1,1-bis-(4-dibenzylaminophenyl)propane, styrl anthracen, styrl pyrazoline, a compound of formula (b), and a compound of formula (e):

(b)

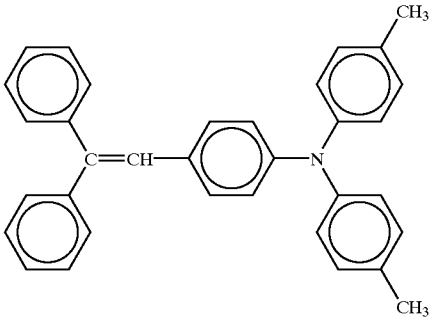

-continued (e)

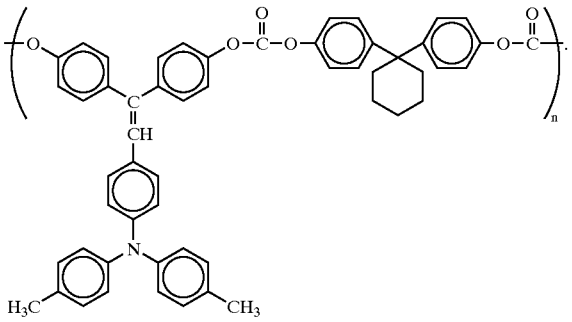

13. The electrophotographic image forming process cartridge according to claim 12, wherein said charge carrier transport material comprises a charge transport polymer material.

14. The electrophotographic image forming process cartridge according to claim 12, wherein said charge carrier transport layer overlies said charge carrier generation layer, and wherein said charge carrier transport layer further comprises a lubricant.

15. The electrophotographic image forming process cartridge according to claim 12, wherein said charge carrier transport layer has a friction coefficient of not greater than 0.5.

16. The electrophotographic image forming process cartridge according to claim 12, further comprising a friction coefficient controlling member, which controls a friction coefficient of a surface of said photoreceptor.

17. The electrophotographic image forming process cartridge according to claim 16, wherein said friction coefficient controlling member applies a lubricant to said surface.

18. The electrophotographic image forming process cartridge according to claim 16, wherein said friction coefficient controlling member controls said friction coefficient so as to be not greater than 0.5.

* * * * *